US007973270B1

(12) United States Patent
Rastegar et al.

(10) Patent No.: US 7,973,270 B1
(45) Date of Patent: Jul. 5, 2011

(54) ACTUATORS FOR GUN-FIRED PROJECTILES AND MORTARS

(75) Inventors: Jahangir S. Rastegar, Stony Brook, NY (US); Thomas Spinelli, Northport, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 0 days.

(21) Appl. No.: 12/870,842

(22) Filed: Aug. 29, 2010

Related U.S. Application Data

(63) Continuation of application No. 11/517,197, filed on Sep. 7, 2006, now Pat. No. 7,800,031.

(51) Int. Cl.
*F42B 10/20* (2006.01)

(52) U.S. Cl. ..... 244/3.28; 244/3.24

(58) Field of Classification Search ..... 244/3.24, 244/3.28, 3.27, 3.29
See application file for complete search history.

(56) References Cited

U.S. PATENT DOCUMENTS

| | | | | | |
|---|---|---|---|---|---|
| 1,300,708 | A | * | 4/1919 | Edison | 244/3.27 |
| 3,125,313 | A | * | 3/1964 | Soderberg | 244/87 |
| 3,289,587 | A | * | 12/1966 | Donnelly et al. | 244/3.28 |
| 3,304,030 | A | * | 2/1967 | Weimholt et al. | 244/3.28 |
| 4,624,424 | A | * | 11/1986 | Pinson | 244/3.21 |
| 4,659,037 | A | * | 4/1987 | Unterstein | 244/3.28 |

* cited by examiner

*Primary Examiner* — Tien Dinh
*Assistant Examiner* — Michael Kreiner

(57) ABSTRACT

A projectile including: a shell; and a movable exterior surface of the shell, the movable exterior surface having one or more actuators for providing thrust to move the movable exterior surface from a first position to a second position.

8 Claims, 6 Drawing Sheets

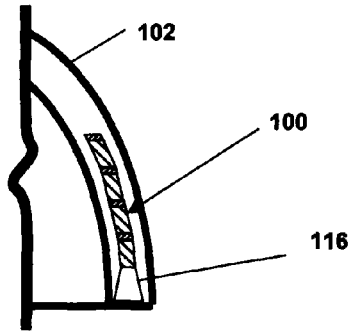
Figure 3a
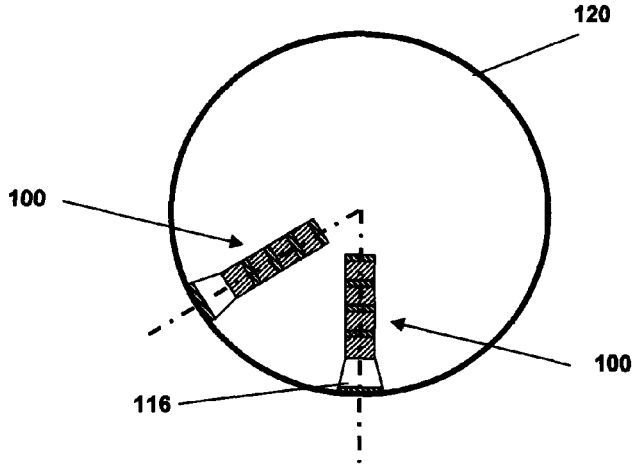
Figure 3b
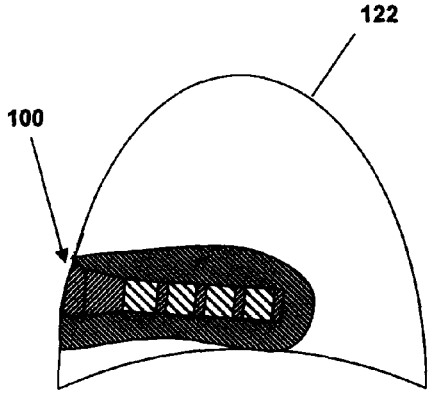
Figure 4a
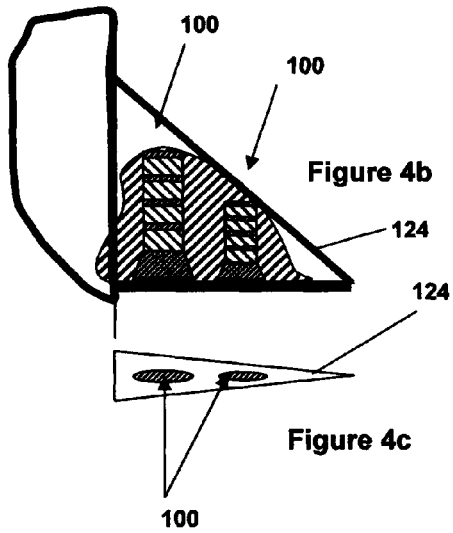
Figure 4b
Figure 4c

ACTUATORS FOR GUN-FIRED PROJECTILES AND MORTARS

CROSS-REFERENCE TO RELATED APPLICATION

This application is a Continuation Application of U.S. application Ser. No. 11/517,197 filed on Sep. 7, 2006 which claims benefit to U.S. Provisional Application Ser. No. 60/714,806 filed Sep. 7, 2005, the entire contents of each of which is incorporated herein by reference.

BACKGROUND OF THE INVENTION

1. Field of the Invention

The present invention relates generally to actuators, and more particularly to actuators for gun-fired projectiles and mortars.

2. Prior Art

Since the introduction of 155 mm guided artillery projectiles in the 1980's, numerous methods and devices have been developed for the guidance and control of subsonic and supersonic gun launched projectiles. The majority of these devices have been developed based on missile and aircraft technologies, which are in many cases difficult or impractical to implement on gun-fired projectiles and mortars. This is particularly true in the case of actuation devices, where electric motors of various designs have dominated the guidance and control of most guided weaponry.

In almost all guided weaponry, such as rockets, actuation devices and batteries used to power the same, occupy a considerable amount of the weaponry's internal volume. In recent years, alternative methods of actuation for flight trajectory correction have been explored, some using smart (active) materials such as piezoelectric ceramics, active polymers, electrostrictive materials, magnetostrictive materials or shape memory alloys, and others using various devices developed based on microelectromechanical (MEMS) and fluidics technologies.

In general, the available smart (active) materials such as piezoelectric ceramics, electrostrictive materials and magnetostrictive materials need to increase their strain capability by at least an order of magnitude in order to become potential candidates for actuator applications for guidance and control, particularly for gun-fired munitions and mortars. In addition, even if the strain rate problems of currently available active materials are solved, their application to gun-fired projectiles and mortars will be very limited due to their very high electrical energy requirements and the volume of the required electrical and electronics gear. Shape memory alloys have good strain characteristics but their dynamic response characteristics (bandwidth) and constitutive behaviour need significant improvement before becoming a viable candidate for actuation devices in general and for munitions in particular.

The currently available and the recently developed novel methods and devices or those known to be under development for guidance and control of airborne vehicles such as missiles, have not been shown to be suitable for gun-fired projectiles and mortars. In fact, none have been successfully demonstrated for gun-fired guided munitions, including gun-fired and mortar rounds. This has generally been the case since almost all the available guidance and control devices and methodologies suffer from one or more of the following major shortcomings for application in gun-fired projectiles and mortars:

1. A limited control authority and dynamic response characteristics considering the dynamics characteristics of gun-fired projectiles and mortars.
2. Reliance on battery-based power for actuation in most available technologies.
3. The relatively large volume requirement for the actuators, batteries and their power electronics.
4. Survivability of many of the existing devices at high-g firing accelerations and reliability of operation post firing.
5. Expensive and complicated.

A need therefore exists for actuation technologies that address these restrictions in a manner that leaves sufficient volume onboard munitions for sensors, guidance and control and communications electronics and fuzing as well as the explosive payload to satisfy lethality requirements.

Such actuation devices must consider the relatively short flight duration for many of the gun-fired projectiles and mortar rounds, which leaves a very short time period within which trajectory correction has to be executed. Such actuation devices must also consider problems related to hardening components for survivability at high firing accelerations and the harsh environment of firing. Reliability is also of much concern since the rounds need to have a shelf life of up to 20 years and could generally be stored at temperatures in the range of −65 to 165 degrees F.

In addition, for years, munitions developers have struggled with placement of components, such as sensors, processors, actuation devices, communications elements and the like within a munitions housing and providing physical interconnections between these components. This task has become even more prohibitive considering the current requirements of making gun-fired munitions and mortars smarter and capable of being guided to their stationary and moving targets, therefore requiring high power consuming and relatively large electrical motors and batteries. It is, therefore, important for all guidance and control actuation devices, their electronics and power sources not to significantly add to the existing problems of integration into the limited projectile volume.

SUMMARY OF THE INVENTION

Accordingly, a projectile is provided. The projectile comprises: a shell; and a movable exterior surface of the shell, the movable exterior surface having one or more actuators for providing thrust to move the movable exterior surface from a first position to a second position.

The movable exterior surface can be a control surface.

The movable exterior surface can be a drag inducing protrusion. The first position can be a retracted position and the second position can be an extended position.

The exterior movable surface can be rotatable between the first and second positions.

The projectile can further comprise a biasing element for biasing the movable exterior surface into one of the first or second positions.

The shell can further comprise a portion for accommodating the movable exterior surface when in one of the first or second positions.

The one or more actuators can comprise a first actuator for moving the movable exterior surface to the first position and a second actuator for moving the movable exterior surface to the second position.

The actuators disclosed herein require minimal electrical power to operate since they can be based on detonation of embedded charges and momentum exchange. These actuation devices are capable of being embedded into the structure of the projectile, such as load bearing structural components, thereby occupying minimal and even no projectile volume. In addition, the actuation devices and their related components are better protected against high firing acceleration loads, vibration, impact loading, repeated loading and acceleration and deceleration cycles that can be experienced during transportation and loading operations.

The actuators disclosed herein can provide impulsive actuation authority, thereby providing the means for actuation for a bang-bang feedback control loop with a very high dynamic response characteristic. Simple impulsive actuation mechanisms based on charge detonation and momentum exchanged is a proven concept for munitions and have been shown to withstand very high firing accelerations. The actuators disclosed herein can be based on this proven technology, with the potential of providing significantly higher control authority with quasi-continuous actuation input. As a result, the guidance and control system of a projectile equipped with the disclosed actuation devices would be capable of achieving significantly enhanced precision for both stationary and moving targets.

Some of the features of the disclosed actuation devices for gun-fired projectiles and mortars include:

1. The disclosed actuators can have high control authority and dynamic response characteristics since they can be based on detonations of charges and momentum exchange. For these reasons, the disclosed actuators are ideal for guidance and control of precision gun-fired projectiles and mortars.

2. The disclosed actuators can require very low electrical power for operation. A large amount of projectile volume is therefore saved by the elimination of large battery-based power sources. Furthermore, by significantly reducing the power requirement, it is possible to used onboard energy harvesting power sources and thereby totally eliminating the need for onboard chemical batteries. As a result, safety and shelf life of the projectile is also significantly increased.

3. The disclosed actuators can be relatively lightweight and occupy very small useful volume of the projectile. This is the case since the disclosed actuators can be integrated into the structure of the projectile as load bearing structures. This is also advantageous from the guidance and control point of view since the actuation force (moment) is applied directly to the round structure without intermediate components. Almost all such intermediate coupling mechanisms also introduce flexibility between the control force (moment) and the projectile structure, thereby reducing the performance of the feedback control system.

4. Due to their integration into the structure of the projectile and their design, the disclosed actuators can be readily hardened to survive very high-g firing loads and very harsh environments of firing. The disclosed concepts lead to highly reliable actuation devices for gun-fired projectiles and mortars.

5. The disclosed actuators can be very simple in design, and are constructed with no moving parts with bearings and other joints, thereby making them highly reliable even following very long storage times of over 20 years.

6. The disclosed actuators can be scalable to any gun-fired projectile and mortar application.

7. The disclosed actuators can be designed to conform to any geometrical shape of the structure of the projectile and the available space within the projectile housing.

8. The disclosed actuators can be capable of being designed as modular units that could be "stacked" or increased in number to obtain the required actuation level and availability in terms of the length of time. As a result, the disclosed actuators provide the means to develop a common actuation device for a very large number of gun-fired projectiles and mortars.

9. The disclosed actuators can be capable of withstanding high vibration, impact and repeated loads when integrated into the structure of the projectile.

10. The disclosed actuators can be very simple in design and utilize mostly existing manufacturing processes and components. As a result, the disclosed actuation devices provide the means to develop highly effective but low cost guidance and control systems for guided gun-fired projectiles and mortars.

11. The disclosed novel actuator concepts provide the means to develop bang-bang feedback guidance and control systems for guided munitions with quasi-continuous control authority. Thus, the disclosed actuators provide cost effective means to significantly increase munitions precision and thereby the probability of a hit.

12. The disclosed actuators can be used in both subsonic and supersonic projectiles.

BRIEF DESCRIPTION OF THE DRAWINGS

These and other features, aspects, and advantages of the apparatus of the present invention will become better understood with regard to the following description, appended claims, and accompanying drawings where:

FIG. 3*a* illustrates a partial sectional view of a curved projectile shell having stacked actuator thrusters integrated into the structure thereof.

FIG. 3*b* illustrates the base or other plates or radial stiffeners structure of a projectile having stacked actuator thrusters integrated into the structure thereof.

FIG. 4*a* illustrates stacked actuator thrusters integrated into the structure of the nose (including fuzing) of a projectile.

FIGS. 4*b* and 4*c* illustrate stacked actuator thrusters integrated into the structure of a fin or canard of a projectile.

FIG. 9*a* illustrates the control surface being retracted and FIG. 9*b* illustrates the control surface being deployed.

DETAILED DESCRIPTION OF THE PREFERRED EMBODIMENT

Although the present invention is applicable to numerous types of actuators, it is particularly useful in the environment of actuators for gun-fired projectiles and mortars. Therefore, without limiting the applicability of the present invention to actuators for gun-fired projectiles and mortars, it will be described in such environment.

The disclosed actuators and method of their manufacture and integration into the structure of projectiles will now described in detail with regard to the Figures. It is shown that the disclosed actuators would provide very cost effective and have high actuation authority and dynamic response characteristics, while occupying very small useful projectile volume and requiring very low electrical power. It is also shown that the disclosed actuators can be capable of being readily scaled to the desired application. The disclosed actuator concepts could be built as modular units and could form the basis for developing a common actuator solution for any gun-fired projectile and mortar.

A first embodiment of the disclosed actuators that can be integrated into the structure of a projectile as load bearing components will now be described. Such actuators can provide discrete impulsive control authority with timing control, thereby forming a quasi-continuous control authority.

The actuators can be constructed with modular actuation "thruster" units, which can be stacked to form a string of thrusters, that could be activated sequentially at the desired times, to provide the impulsive momentum transfer to the round. The actuators can be detonated electronically; thereby they could be detonated very rapidly or at relatively large time intervals to achieve the desired control action.

Figure 1A:
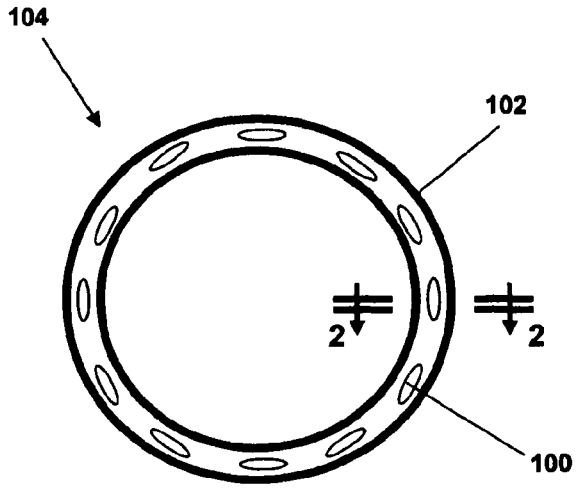
FIG. 1*a* illustrates a sectional view of a first embodiment of a projectile shell with structurally integrated stacked actuator "thruster" units.
Figure 1B:
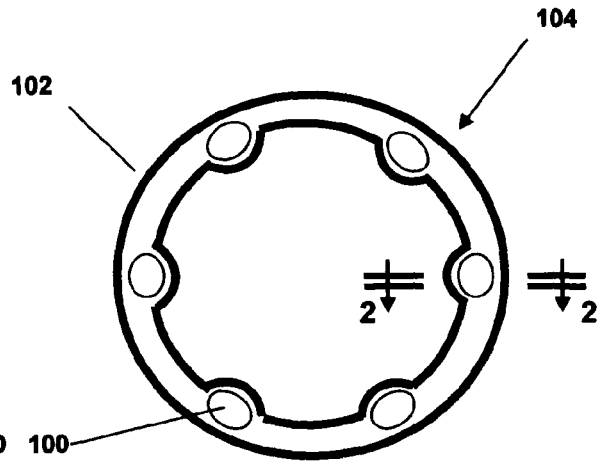
FIG. 1*b* illustrates a sectional view of a second embodiment of a projectile shell with structurally integrated stacked actuator "thruster" units.

The schematic of the cross-sectional view of the shell of a projectile with structurally integrated quasi-continuous stacked actuator thruster units is shown in FIGS. 1*a* and 1*b*. The cross-section view 2-2 showing a sectioned longitudinal view of the stacked actuators as embedded in the shell of the projectile and the "exhaust" nozzle is shown in FIG. 2.

As can be seen in FIGS. 1*a* and 1*b*, stacks of actuator thruster units 100 are integrated into the structure (e.g., shell) 102 of a projectile 104, in this case along the length (in a direction of flight) of the projectile 104. In the schematics shown in FIG. 1*a*, twelve such actuator thruster units 100 (or stacks) are distributed symmetrically around the shell 102 of the projectile 104 while FIG. 1*b* illustrates six such actuator thruster units 100. In the schematics of FIGS. 1*a* and 1*b*, the actuator thruster units 100 are shown to have an oval cross-section. However, the actuator thruster units 100 may have any appropriate cross-section and they may be distributed in any number or configuration about the shell 102 of the projectile 104. The actuator thruster units 100 may be completely disposed within the confines of the projectile shell as shown in FIG. 1*a* or partially disposed therein as shown in FIG. 1*b*.

The shape of the cross-section of the actuator thruster units 100 can be dependent on the material of the shell structure. If the shell 102 is metal and the actuator thruster space has to be machined into the shell wall, then the cross-sectional shape of the actuator thruster units 100 can be cylindrical columns with circular cross-sections. If the shell 102 is constructed with certain composite materials, then the stacked actuator thruster units 100 can be constructed with the housing shell in any number of appropriate cross-sectional shapes. The actuator thruster stack assembly can be embedded into the structure of the projectile composite shell during its construction. The actuator thruster stack housing can be constructed in the shape of patented structural elements (as discussed below).

Figure 2:
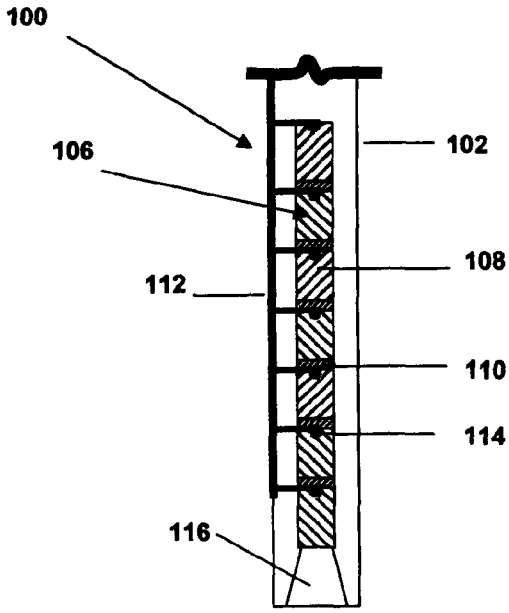
FIG. 2 illustrates a sectional view of the projectile shell as taken along line 2-2 of FIGS. 1*a* and/or 1*b* showing stacked actuator thrusters and an exhaust nozzle embedded into the shell of a projectile.

As shown in FIG. 2, the actuator thruster units 100 comprise one or more individual thrusters 106 including a detonation charge 108 and a separation layer 110. The detonation charges and separation layer materials are well known in the art. Detonation wiring is disposed throughout the actuator thruster unit to provide power to each of the individual thruster units 106 terminating in a primer 114 for selective detonation of the detonation charges 108. An exhaust nozzle 116 can be disposed at the end of the individual thruster units 106 to expel any exhaust gases from the detonations.

The projectile housings are preferably constructed as long sections, which are then cut to the desired length for assembly as a complete stacked actuator thruster together with its end nozzle. Such actuator housings may also be attached to the interior surface of a metal projectile shell and then be stacked with the detonation chargers, primers, etc. In general, the nozzles may serve as an actuator stage, thereby filled with detonation charges and capped with the sealing materials.

It is also noted that the projectile shell does not have to be cylindrical to accommodate the disclosed stacked actuator thrusters, since they could be bent to accommodate the shell geometry, such as curved surfaces 118 as shown in the cross-sectional view of FIG. 3*a*, including on a helical or other curved paths on any type of shell surfaces. Such curved stacked actuator paths are obviously very difficult to machine into the shell wall, therefore they may be more suitable for incorporation into the composite and molded projectile shells.

The disclosed stacked actuator thrusters 100 may also be integrated into other parts of the projectile structure. These include, but are not limited to, in the radial direction into the base 120 or other transverse plates or radial stiffeners of the projectile as shown in FIG. 3*b*. Two such stacked actuator thrusters 100 are shown in FIG. 3*b*, however, more or less can be provided and disposed about the circumference in any manner, which may be symmetrical or asymmetrical. The stacked actuator thrusters 100 can also be provided in the nose 122 of the projectile as shown in FIG. 4*a* and in (or on) fins or canards 124 of the projectile as shown in FIGS. 4*b* and 4*c*. As with FIG. 3*b*, the stacked actuator thrusters 100 shown in FIGS. 4*a*-4*c* can be provided in any number or configuration.

A limited number of stacked actuation thruster designs are presented herein, however, as can be readily observed, the actuation thrusters may be designed in an infinite number of geometries. One configuration of actuators can use a housing shell with a geometry as disclosed in U.S. Pat. Nos. 6,054,197, issued April 2000; 6,082,072, issued July 2000; 6,080,066, issued June 2000; 6,112,410, issued September 2000; 6,370,833, issued April 2002; 6,474,039, issued November 2002; and 6,575,715 each of which are incorporated herein by their reference. The configurations disclosed therein make it particularly suitable for the present actuator applications due to its capability to withstand high internal pressures. Such an actuator housing geometry can also resist very high internal pressure with minimal volume displacement, i.e., bulging; thereby it is suitable for integration in the structure of projectiles. In addition, actuator thrusters constructed with such a geometry provides very strong and stiff structural elements, ideal for construction of structures that are subject to high compressive loads of firing.

It is noted that in the above schematics of the disclosed novel stacked actuator thrusters, each stack is drawn with a significant length relative to its width. Each stack may, however have a very limited length, thereby allowing a relatively large number of units to be stacked together, thereby allowing the actuator to operate very close to one another with a near continuous control authority. In addition, since each actuator unit can have its own independently operated primer, more than one unit could be detonated at the same time, thereby allowing the generation of large impulsive forces (moments).

As discussed above, each actuator thruster unit can have a housing, which is configured based on the aforementioned geometry disclosed in U.S. Pat. Nos. 6,054,197, issued April 2000; 6,082,072, issued July 2000; 6,080,066, issued June 2000; 6,112,410, issued September 2000; 6,370,833, issued April 2002; 6,474,039, issued November 2002; and 6,575,715. The actuator thruster housing is then filled with the appropriate detonation charges, primer and spacer material. Thereby making the actuator unit very stiff and capable of resisting high compressive loads experienced by a projectile during firing. As a result, the actuator thruster units (used as single units or in their stacked configuration) can be integrated into the structure of projectiles as load bearing members, thereby minimizing the useful projectile space required to house the guidance and control actuators without adversely affecting the structural integrity of the projectile shell. In general, such actuator unit housing can be constructed in any desirable shape and geometry to conform to the available geometry of the projectile. Although discussed as being formed within the shell, the actuator units can also be formed on an inner or outer surface of the shell or partially formed in and partially formed on an inner or outer surface of the shell.

Figure 5:
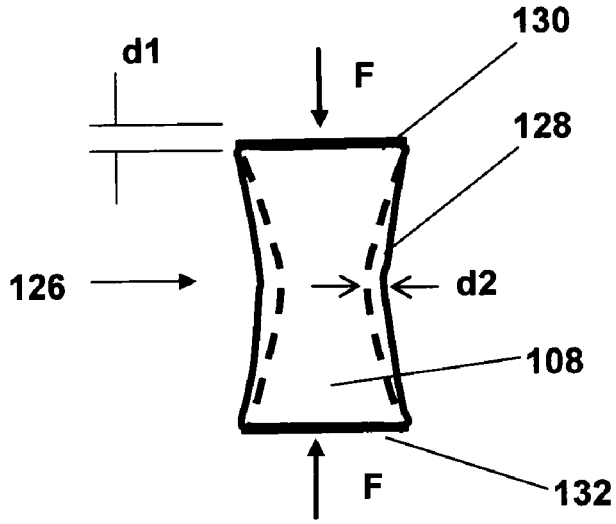
FIG. 5 illustrates a schematic view of an actuator unit housing.

The schematic of the longitudinal cross-section of a typical such actuator unit housing 126 is shown in FIG. 5. Each actuator unit housing is constructed with a relatively thin sidewall(s) 128. Although the housing 126 is shown with a cylindrical shape, as is described in the aforementioned patents, the housing 126 could be formed into almost any shape to fully conform to the available space as long as its sidewalls 128 are constructed to buckle inward (by a deflection d) under compressive loads (F). The housing is then filled completely with the detonation and primer chemicals.

If such a structural element were loaded in compression with the force F, then the sidewalls would tend to deflect ("buckle") inwards a distance d2. By constructing the sidewalls with a small inward curvature, a small movement d1 of the top 130 and bottom 132 surfaces towards each other caused by the compressive force F results in a relatively large amplified deflection d2. The top and bottom surfaces can be the separation layers 110. Since the inside volume of the structural element can be filled with relatively incompressible medium (e.g., a liquid or gel detonation charge), internal pressure would then build up within the housing and the side walls are prevented from deflecting inwards, more or less acting as an arched structure under pressure. As a result, such structural elements are relatively rigid and can carry very large loads. Actuator housing units constructed with such geometries can therefore be embedded into the structure of gun-fired munitions and mortars as load bearing elements. In addition, when the actuator thruster is activated, the sidewalls and the closed end of the housing unit will act as arched structures, thereby resisting the build-up of the pressure within the housing following the detonation of the internal charges.

The actuator unit housings shown in FIG. 5 can be constructed with almost any geometrical shape and size as long as one or more of their sidewalls are designed with a slight curvature such that under loading, they would tend to deflect (buckle) inwards into the incompressible material disposed therein. Such actuator units can form an integral part of a composite projectile shell or can be constructed with a metal housing and form part of the structure of the projectile. Such actuator units can even be machined into the structure of the projectile shell. The structure of the resulting projectile shell is not weakened since such structural elements are load bearing and can be optimally designed to provide the required structural strength and stiffness. In addition, due to their inherent high internal damping, the projectile structure as well as its interior elements should therefore be able to better withstand shock, vibration and acoustic disturbances.

The disclosed novel structurally integrated conformal and load-bearing actuator thrusters are suitable for distribution over the structure of the projectile. The actuator units may be used as single units or be stacked for sequential firing. The actuator thrusters would therefore occupy minimal space and in some applications may not even require any space within the structure of the projectile. The above actuator thrusters, particularly in their stacked configuration, are particularly suitable for integration into the composite shells structures. Such thruster units can also be formed in a cylinder and fixed in a hole formed in the shell by any methods known in the art, such as with fasteners, by welding or otherwise adhering.

The optimally designed actuator housing may require added loop and longitudinal stiffeners to allow the units to withstand the compressive firing loads and the internal pressure developed due to their activation.

Figure 6:
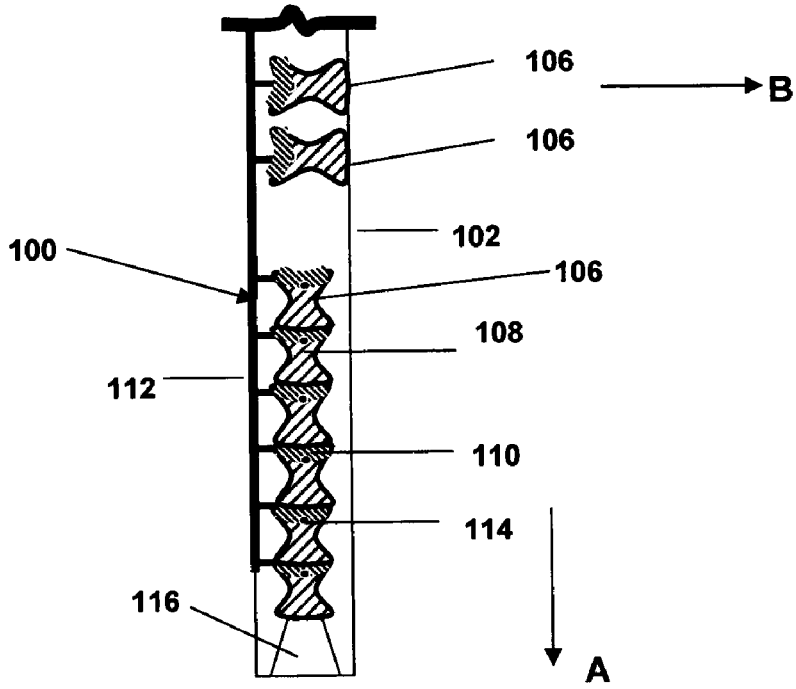
FIG. 6 illustrates a sectional view of a projectile shell with integrated stacked and individual actuator units.

The above actuator thruster units may be integrated into the structure of the gun-fired projectiles and mortars, into the areas of the nose, fins or canards as described above. In the schematic of FIGS. 6, a cross-section of the projectile wall with six stacked individual actuator units 106 embedded into the structure of the shell 102 for generating impulsive forces in the longitudinal direction (A), and two individual actuator units 106 embedded into the same wall 102 for producing lateral impulsive forces in direction B are illustrated. The detonation wiring 112 is also shown and for the case of projectiles with composite shells could be embedded into the structure or attached to an inner surface of the shell.

Figure 7:
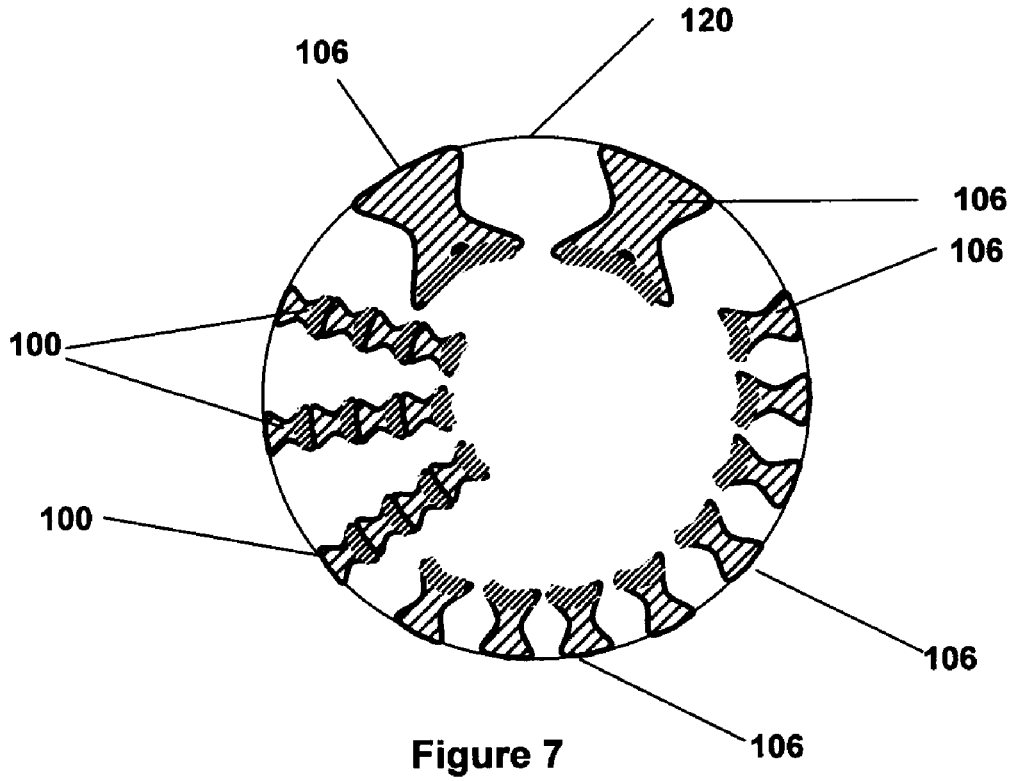
FIG. 7 illustrates a first embodiment of stacked and individual actuator units integrated into the base or other transverse plates or radial stiffeners of a projectile.

In the schematic of FIG. 7, stacked actuator units 100 and individual units 106 of difference sizes are shown as integrated into a base 120 or intermediate plate or radial stiffener of the projectile 104. The detonation wiring is not shown in FIG. 7 for simplicity.

Figure 8:
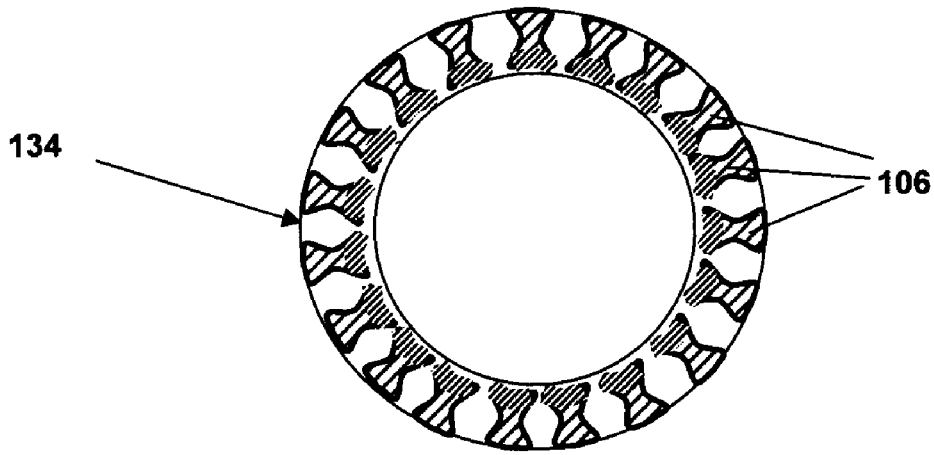
FIG. 8 illustrates a second embodiment of stacked and individual actuator units integrated into the base or other transverse plates or radial stiffeners of a projectile.

In FIG. 8, individual actuator units 106 are shown embedded around the periphery of a ring 134. Such a ring 134 may be positioned at any available position along the length of the projectile. In particular, such actuation rings are most appropriate for placement along the length (e.g., direction A) of a projectile that is constructed as two or more parts and are then screwed together at certain parting line, such as under the fuzing in certain projectiles. One or more of such rings 134 can be disposed at one or more of such parting lines by any fastening means known in the art, such as with conventional fasteners. Although the actuator units 106 are shown along radial lines from a center of the ring 134, they can also be offset at an angle from the radial lines and thereby also impart a rotation on the projectile 104. The ring 134 may also utilize stacked actuator units 100 or any combination of the same and individual actuators 106. The detonation wiring is not shown in FIG. 8 for simplicity.

The present stacked and individual actuator thruster units can also be integrated into the curved projectile shells as shown in FIG. 3*a*; into the nose (including the fuzing) as shown in FIG. 4*a*; and into the fins and canards as shown in FIG. 4*b*. In addition, it is noted that even though each individual actuator unit is schematically illustrated with only one detonation charge, such actuator units could also be packed with layers of individually charges to allow the actuator to operate with a quasi-continuous control authority.

It should be stated that using thrusters for steering missiles is well known in the missile arts. Such thrusters use propellant and nozzles to provide a thrust for steering a missile or other projectile. Typically, the thrusters include sideways facing nozzles that are both bulky and complicated. Since such thrusters are bulky, they cannot be arranged close together and they occupy a considerable amount of internal volume, which makes them effectively impractical for gun-fired projectiles and mortars. In addition, such thrusters are not useful for providing thrust in every direction or a complicated mechanism is necessary for steering the direction of the nozzles.

The known thruster systems suffer from disadvantages which are overcome by the disclosed actuators. Several advantages of the disclosed design are discussed above. For example, integration of the actuators 100, 106 in the shell of the projectile provides more interior space for other components. Integration of the thrusters in the shell also provides for a stiffer shell if the actuators are configured to provide stiffness and damping, such as those discussed above with regard to FIG. 5. Additionally, the prior art thruster systems do not allow for stacking of the thrusters longitudinally as shown in FIGS. 2, 3*a*, 3*b*, 4*a*, 4*b*, and 6 or stacking of the thrusters radially as shown in FIGS. 7 and 8.

In addition to the novel configurations discussed above, the actuators 100, 106 can be distributed over the surface of the projectiles or be provided in a continuous circumferential ring of radial thrusters separated by a thin material, such as metal sheet or wax. Such configurations eliminate the need to steer the nozzles, as done in the prior art systems because the spacing between thruster elements is nearly continuous. The circumferential ring of actuators can be pre-fabricated and easily assembled together with the shell of the projectile. Alternatively, the shell of the projectile can be fabricated with a circumferential channel and the circumferential actuators can be manufactured in a linear array and "wrapped" around the projectile shell in the channel. The circumferential ring of actuators can also be stacked in the radial direction similar to that shown in FIG. 7.

Where the actuators are continuous (either longitudinally, radially, or circumferentially), the novel systems disclosed herein have the flexibility to simultaneously fire a group of continuous thrusters (radially, circumferentially and/or longitudinally) to tailor the amount and/or direction of generated thrust.

The novel actuators presented above can operate based on ejecting certain amount of mass, mostly in the form of detonated gasses, away from the moving projectile at certain velocity. The momentum of the exhausted mass will then impart an impulse on the projectile, equal but opposite to the momentum of the exhausted gasses. The actuators may also be constructed with a frontal mass, which is fired out of the actuator housing in a manner similar to that of a bullet. A question may, however, be raised as whether the disclosed (no solid mass) thrusters or the solid mass firing actuation devices are more effective as actuation devices for a flying projectile. This issue will now be addressed using a simplified but valid explanation showing that thrusters filled with detonation charges alone are significantly more effective than those firing solid masses.

Consider two thrusters with the same volume, one filled completely with certain detonation charges and the other filled halfway with the same detonation charges and halfway with a solid mass. When the latter thruster is activated, the charges are detonated, producing high-pressure gasses that travel at certain velocity, i.e., with certain amount of momentum. The momentum of the detonation gasses is then partially passed to the solid mass, which exits the actuator housing with certain velocity and thereby momentum, depending on the length of its travel inside the pressurized actuator housing. The total impulse applied to the projectile will then be the sum of the solid mass and the exhaust gas momentum. Even if we assume that this momentum transfer is highly efficient and involves no losses, the maximum momentum transfer to the projectile is still equal to that of the initial detonation charges. In other words, the inclusion of a solid mass does not increase the effectiveness of thrusters filled with equal amounts of detonation charges. However, in the absence of a solid mass, the thruster volume can be filled with larger amounts of detonation charges (double the amount for the above example), therefore generating a significantly greater momentum and consequently providing a significantly larger amount of impulse to the flying projectile. The actuator thruster becomes even more effective by the provision of appropriately designed nozzles that would transform more of the potential energy of the pressurized gasses into kinetic energy, thereby higher exit velocity and momentum of the exhaust gasses.

The actuators presented above can operate based on ejecting detonated gasses from the moving projectile at certain relative velocity. The process can be described in a simplified manner as follows. Following detonation of the charge, the generated gases are pressurized due to the rapid expansion of the generated gasses and the constraints of the actuator housing. In the meanwhile, the potential energy stored in the pressurized gas begins to be transferred to kinetic energy of the exiting gasses. The exit velocity is greatly enhanced if the pressurized gasses are forced to pass through an accelerating nozzle, thereby achieving greater exit velocity and momentum accompanied by a drop in the gas pressure. The momentum of the exhausted gaseous mass will then impart an impulse on the projectile, equal but opposite to the momentum of the exhausted gasses.

In another embodiment of actuators disclosed herein, the detonation generated pressure is used directly to actuate or "launch" and/or "retract" a control surface or a drag inducing protrusion or the like to develop the desired control authority. In fact, by sequential detonation of charges, one could deploy and actuate almost any control surface or drag producing elements requiring rotary or linear actuation motions (force, moment or torque). Using the disclosed novel charge detonation actuation mechanisms, one can in fact develop linear and rotary "stepper motors" that operates in a manner similar to electrically operated stepper motors. The details of the operation of one such on-off actuator is presented to illustrate the basic mechanism of their operation. The following is a partial list of such actuation devices and their mode of operation:

1. Two position, "on-off" or "in and out", actuators providing rotary or linear or other arbitrary motion. One action of a detonation pressure pushes the actuator mechanism to one position and another detonation pressure action beings the actuator mechanism to another position. Such actuators can be used to deploy and retract control surfaces or drag inducing elements to generate control authority. The mechanism may be spring loaded similar to toggle switches to bias the mechanism towards either of the two positions.

2. Detonation pressure activated actuators similar to the above but with multiple positioning states. In such actuators, each detonation moves the actuation mechanism one step forwards or backward.

3. Actuation mechanisms that utilize the detonation pressure to vary the geometry of the projectile shell, nose, fins, canards, etc., to create a control surface or drag-inducing element or produce certain aerodynamics effects. The action may consist of deforming or morphing certain segment, detaching a segment, or the like. In certain cases, the affected changes are reversible by a second charge or a biased springs or the like.

Although described with respect to control surfaces for projectiles, the detonation actuators have general use in for operating linear or rotary motors in general, or to actuate mechanisms in general using detonated charges.

Figure 9:
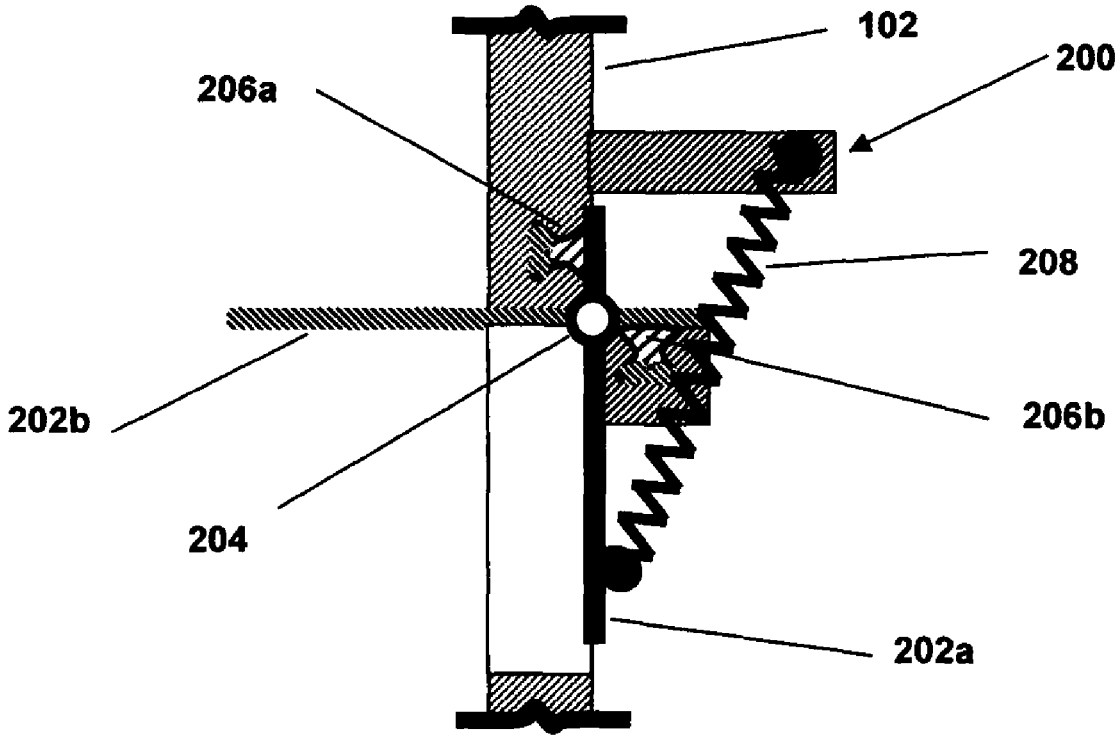
FIGS. 9*a* and 9*b* illustrate a schematic view of a two-position actuation mechanism for repeated deployment and refraction of a control surface where
Figure 9A:
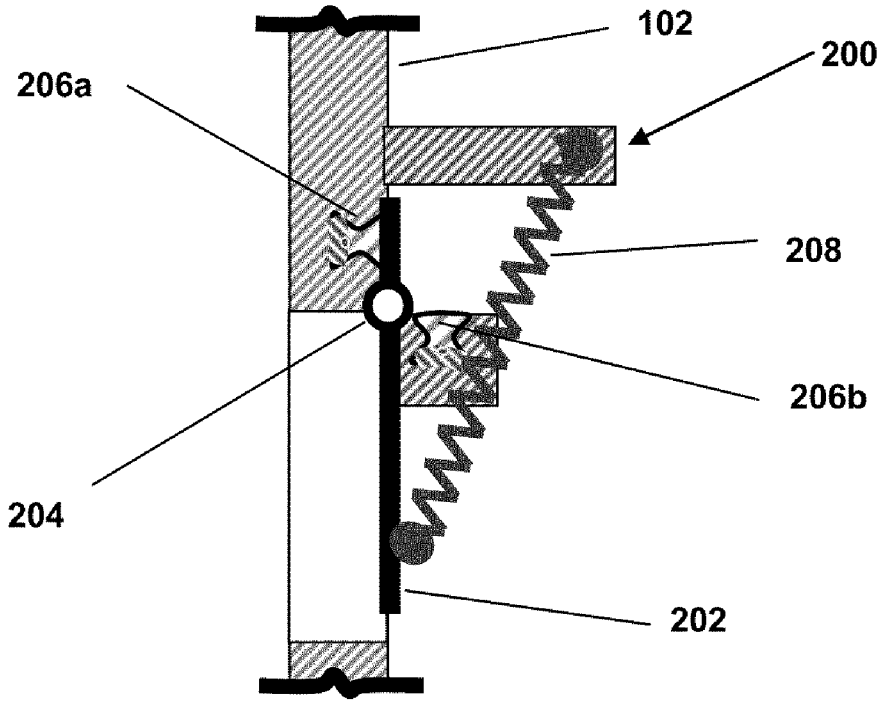
Figure 9B:
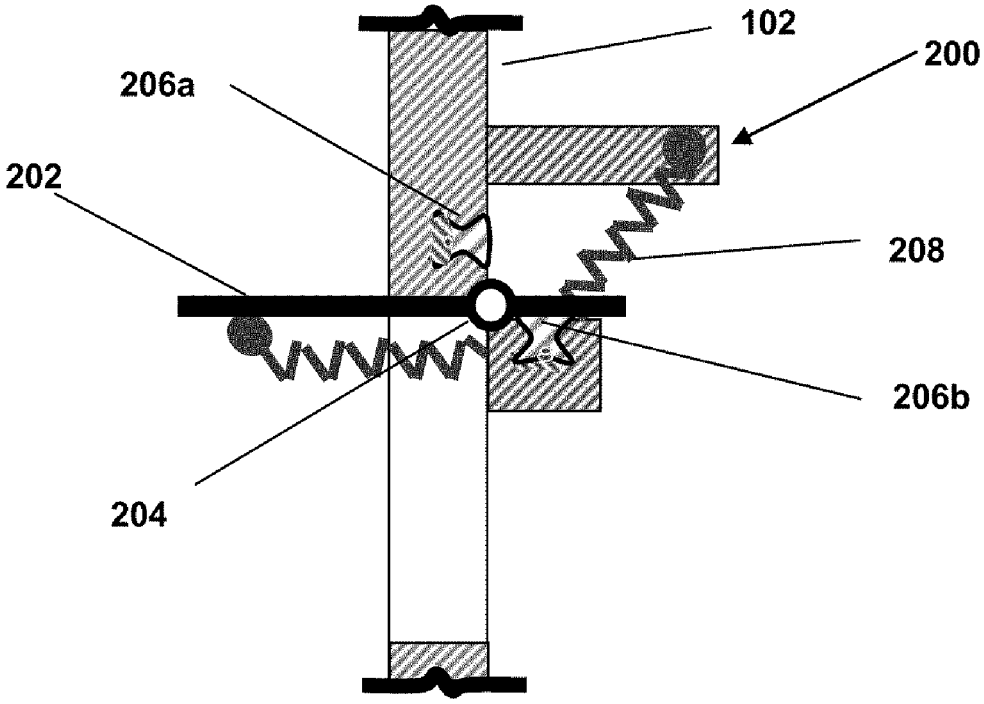

The schematic of a two-position rotary actuator 200 is shown in FIGS. 9*a* and 9*b*. The actuator 200 consists of a control surface (or member) 202 that is hinged to the projectile shell 102 about hinge 204. The control surface 202 is shown in FIG. 9*a* in the retracted position and in the deployed position in FIG. 9*b*. The control surface 202 acts as a toggle switch that is forced into its deployed position by a detonated charge 206*a* and is similarly retracted by a second detonated charge 206*b*. The control surface 202 is deployed and retracted through an appropriately sized opening in the shell 102 or from a recess formed in the shell 102 or simply from a surface on the shell 102. A toggle spring 208 applies a stabilizing force to the control surface 202 at its retracted and its deployed positions.

The method of actuation of a mechanism link (control surface) shown in FIGS. 9*a* and 9*b* can be readily extended to other linear or rotary motion generating actuation mechanisms. The detonation charges can be stacked with individual charges to allow repeated actuation of the control surface 202.

The disclosed novel concepts provide impulsive actuation authority, thereby providing the means for the construction of a bang-bang feedback control loop with very high dynamic response characteristics. Simple impulsive actuation mechanisms based on charge detonation and momentum exchanged is a proven concept for munitions and have been shown to withstand very high firing accelerations. The disclosed novel actuator concepts are based on this proven technology, with the potential of providing significantly higher control authority with quasi-continuous actuation input. As a result, the guidance and control system of a projectile equipped with the disclosed actuation devices should be capable of achieving significantly higher precision for both stationary and moving targets.

By providing a quasi-continuous actuation authority, the guidance and control system of a projectile is capable to provide feedback control for course correction during a long portion or even the entire duration of the flight, thereby allowing a significant amount of maneuvering, dynamic retargeting and significantly higher probability of hit for both stationary and moving targets.

The novel thruster configurations disclosed above for gun-fired projectiles, mortars and missiles could also be used for commercial missiles, such as those used for deployment of commercial satellites. The thruster configurations disclosed above could also be used on the satellites themselves once deployed. Thus, such thruster configurations are useful in properly orienting a missile carrying a satellite as well as for directional control of the satellite itself once deployed into orbit.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A gun-fired projectile comprising:

a shell; and a movable exterior surface of the shell, the movable exterior surface having one or more detonation charges for providing thrust to move the movable exterior surface from a first position to a second position, wherein the one or more actuators comprise a first detonation charge for moving the movable exterior surface to the second position and a second detonation charge for moving the movable exterior surface from the second position to the first position.

2. The projectile of claim 1, wherein the movable exterior surface is a control surface.

3. The projectile of claim 1, wherein the movable exterior surface is a drag inducing protrusion.

4. The projectile of claim 3, wherein the first position is a refracted position and the second position is an extended position.

5. The projectile of claim 1, wherein the exterior movable surface is rotatable between the first and second positions.

6. The projectile of claim 1, further comprising a biasing element for biasing the movable exterior surface into one of the first or second positions.

7. The projectile of claim 1, wherein the shell further comprises a portion for accommodating the movable exterior surface when in one of the first or second positions.

8. The projectile of claim 1, wherein the movement of the movable exterior surface is stepwise from the first position to the second position.

* * * * *